US007036977B2

(12) United States Patent
Mühle

(10) Patent No.: US 7,036,977 B2
(45) Date of Patent: May 2, 2006

(54) PRECISION REGULATING DEVICE

(75) Inventor: Hans-Jürgen Mühle, Dohna (DE)

(73) Assignee: Mühle-Glashütte GmbH Nautische Instrumente & Feinmechanik, Glashüette (DE)

( * ) Notice: Subject to any disclaimer, the term of this patent is extended or adjusted under 35 U.S.C. 154(b) by 139 days.

(21) Appl. No.: 10/859,035

(22) Filed: Jun. 2, 2004

(65) Prior Publication Data

US 2005/0013201 A1 Jan. 20, 2005

(30) Foreign Application Priority Data

Jun. 7, 2003 (DE) ..... 103 26 198

(51) Int. Cl.
*G04B 17/04* (2006.01)
*G04B 17/20* (2006.01)

(52) U.S. Cl. ..... 368/170; 368/175

(58) Field of Classification Search ..... 368/170, 368/175–178; 968/116, 117, 119
See application file for complete search history.

(56) References Cited

U.S. PATENT DOCUMENTS 3,306,026 A * 2/1967 Kocher ..... 368/170
3,579,977 A * 5/1971 Meylan-Rochat ..... 368/173
3,630,016 A * 12/1971 Fujihira ..... 368/170
3,638,419 A * 2/1972 Diersbock ..... 368/175
3,733,808 A * 5/1973 Wolber et al. ..... 368/173
3,745,763 A * 7/1973 Zaugg ..... 368/176
3,896,614 A * 7/1975 Bachmann ..... 368/175
4,083,179 A * 4/1978 Giger et al. ..... 368/184

FOREIGN PATENT DOCUMENTS

DE 26 48 749 B2 5/1977
DE 44 35 704 C2 4/1996

* cited by examiner

*Primary Examiner*—Kamand Cuneo
*Assistant Examiner*—Jeanne-Marguerite Goodwin
(74) *Attorney, Agent, or Firm*—Cohen, Pontani, Lieberman & Pavane

(57) ABSTRACT

A precision regulating device for the regulator pointer of a timepiece includes a balance cock and an index regulator mounted on the balance cock such that the index regulator is pivotable about a regulator axis. A hairspring key arranged on the index regulator at a radial distance from the regulator axis allows changing the active length of a hairspring of the oscillating system of the timepiece in response to pivoting of the index regulator. The index regulator also includes a radially directed regulator pointer. A counterpressure spring including a resilient arm has one end region fastened on the balance cock and another free end region arranged so that it forces the regulator pointer, under prestressing, in the pivoting direction and holds it in abutment against a regulating screw arranged in a rotatable manner in a threaded bore of the balance cock or a component connected to the balance cock. The resilient arm has a holding-down region which can be positioned on an axial side of the regulator pointer relative to the regulator axis.

13 Claims, 4 Drawing Sheets

PRECISION REGULATING DEVICE

BACKGROUND OF THE INVENTION

1. Field of the Invention

The invention relates to a precision regulating device for the regulator pointer of a timepiece, the regulator device having a balance cock, an index regulator mounted on the balance cock such that the index regulator is pivotable about a regulator axis, a hairspring key arranged on the index regulator at a radial distance from the regulator axis and intended for changing the active length of a hairspring of the oscillating system of the timepiece, and a radially directed regulator pointer having a counterpressure spring which is designed as a resilient arm having one end region fastened on the balance cock and another free end region arranged so that it forces the regulator pointer, under prestressing, in the pivoting direction and holds it in abutment against a regulating screw arranged in a rotatable manner in a threaded bore of the balance cock or a component connected to the balance cock.

2. Description of the Related Art

In precision regulating devices, the resilient arm and/or the regulator pointer have a small thickness because of the small overall sizes of the timepiece parts. When the timepiece is subjected to relatively pronounced shocks, the counterpressure spring may oscillate and lift off axially from the regulator pointer, so that the regulator pointer is no longer held in abutment against the regulating screw.

SUMMARY OF THE INVENTION

An object of the invention is thus to provide a precision regulating device which overcomes the problems of the prior art and in which it is ensured that the regulator pointer is forced against the regulating screw by the counterpressure spring.

The object of the present invention is achieved by a resilient arm that has a holding-down region which can be positioned, axially in relation to the regulator axis, on a side of the regulator pointer which is directed away from and/or towards the balance cock.

This design, without any additional components, prevents the regulator pointer from moving axially away from the counterpressure spring. If the regulator pointer here rests axially on the surface of the balance cock, all that is necessary is for the holding-down region to butt against that side of the regulator pointer which is directed away from the balance cock, since oscillation in the other direction is prevented by the abutment against the balance cock.

The situation where the resilient arm lifts off away from the regulator pointer is avoided in that the holding-down region of the resilient arm can be positioned on the regulator pointer, axially in relation to the regulator axis, with a low level of prestressing.

For the regulator pointer to be subjected to a reliable linear forcing action, the free end region of the resilient arm may butt against the regulator pointer by a region of action which is curved approximately convexly in relation to the longitudinal extent of the regulator pointer.

SUMMARY OF THE INVENTION

An object of the invention is thus to provide a precision regulating device which overcomes the problems of the prior art and in which it is ensured that the regulator pointer is forced against the regulating screw by the counterpressure spring.

The object of the present invention is achieved by a resilient arm that has a holding-down region which can be positioned, axially in relation to the regulator axis, on a side of the regulator pointer which is directed away from and/or towards the balance cock.

This design, without any additional components, prevents the regulator pointer from moving axially away from the counterpressure spring. If the regulator pointer here rests axially on the surface of the balance cock, all that is necessary is for the holding-down region to butt against that side of the regulator pointer which is directed away from the balance cock, since oscillation in the other direction is prevented by the abutment against the balance cock.

The situation where the resilient arm lifts off away from the regulator pointer is avoided in that the holding-down region of the resilient arm can be positioned on the regulator pointer, axially in relation to the regulator axis, with a low level of prestressing.

For the regulator pointer to be subjected to a reliable linear forcing action, the free end region of the resilient arm may butt against the regulator pointer by a region of action which is curved approximately convexly in relation to the longitudinal extent of the regulator pointer.

Since the free end region of the resilient arm is always located in abutment with or proximate the regulator pointer, the holding-down region is preferably arranged on the free end region of the resilient arm, in particular in the area of the region of action. It is thus possible to keep the size of the holding-down region small.

In a straightforward embodiment, the region of action and holding-down region may be spaced apart from the regulator axis by approximately the same radial distance if the region of action and holding-down region are arranged in a stepped manner one beside the other, approximately axially in relation to the regulator axis, such that the holding-down region projects further in the direction of the regulator pointer than the region of action.

If, on its side which is directed towards the holding-down region of the resilient arm, the regulator pointer has a depression, into which the holding-down region projects, then the resilient arm only projects axially to a slight extent, if at all, from the plane of the regulator pointer and does not require any additional installation space.

A small overall size is achieved if the regulator pointer and resilient arm are arranged in approximately the same plane at right angles to the regulator-pointer axis.

Advantageous resilient behaviour of the resilient arm is achieved in that the resilient arm of the counterpressure spring extends approximately concavely in relation to the longitudinal extent of the regulator pointer.

The counterpressure spring may have a retaining region which extends from that end of the counterpressure spring which is fastened on the balance cock to that end of the resilient arm which is opposite the holding-down region.

If the retaining region extends from the end which is fastened on the balance cock, approximately in the direction of rotary movement of the regulator pointer, approximately into the pivoting region of the tip of the regulator pointer, then the direction of action in which the regulator pointer is forced by the counterpressure spring in the different pivoting positions of the regulator pointer remains largely the same. At the same time, only a small amount of installation space is necessary for the counterpressure spring.

The amount of installation space required may also be reduced if the side of the balance cock directed towards the regulator pointer has a recessed cutout, in which the regulator pointer and counterpressure spring are arranged such that they can be moved in their plane perpendicular to the regulator axis.

If the threaded bore for accommodating the regulating screw here is formed in a side wall of the recessed cutout in the balance cock, then there is no need for any additional components which have the thread for accommodating the regulating screw to be connected to the balance cock.

To secure the regulating screw in its set position, a further threaded bore for accommodating a locking screw extending axially relative to the regulator axis may be arranged directly alongside the threaded bore for accommodating the regulating screw. The screw head of the locking screw can subject the regulating screw to clamping action.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
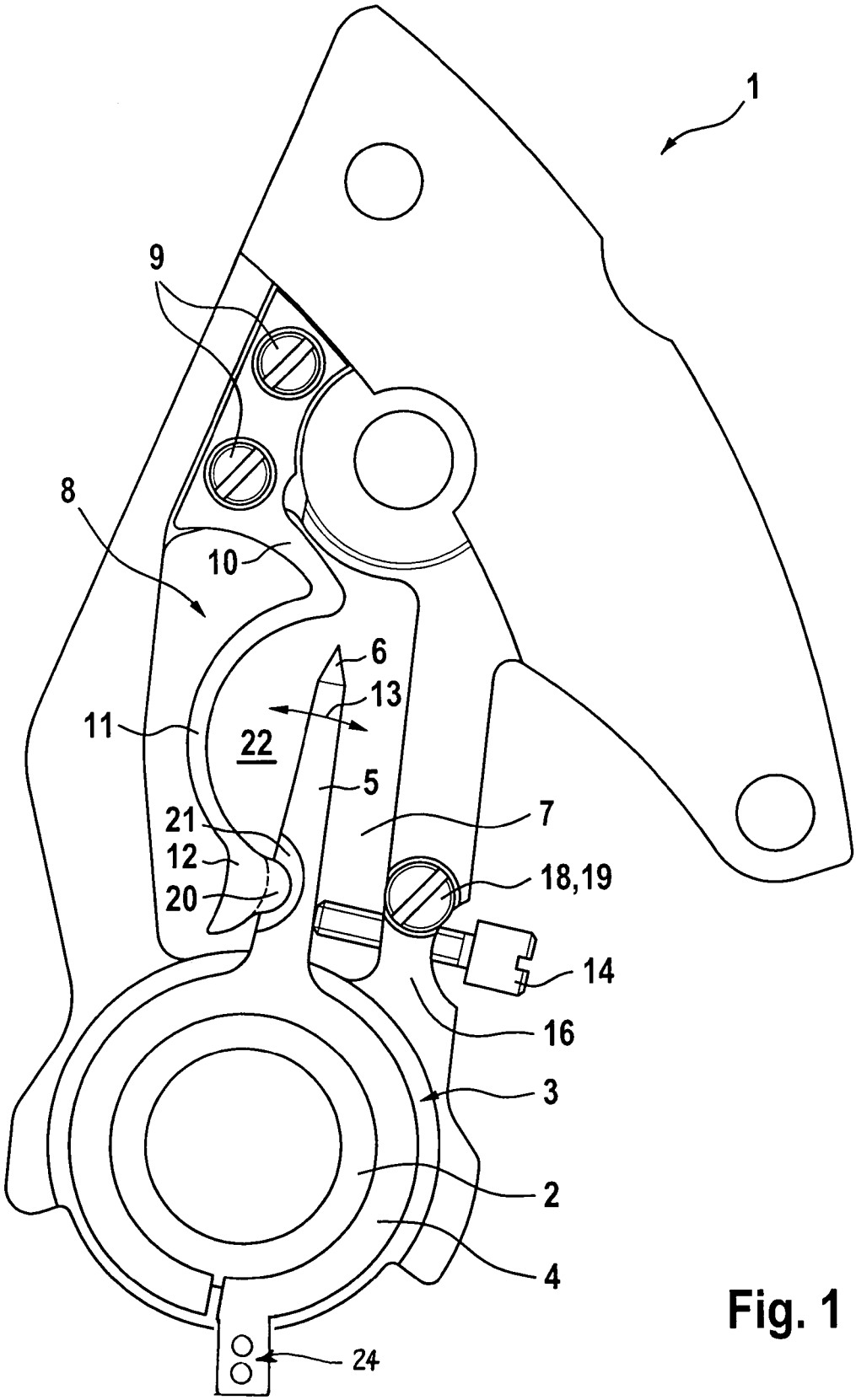
FIG. 1 is a front view of a precision regulating device according to the invention.
Figure 2:
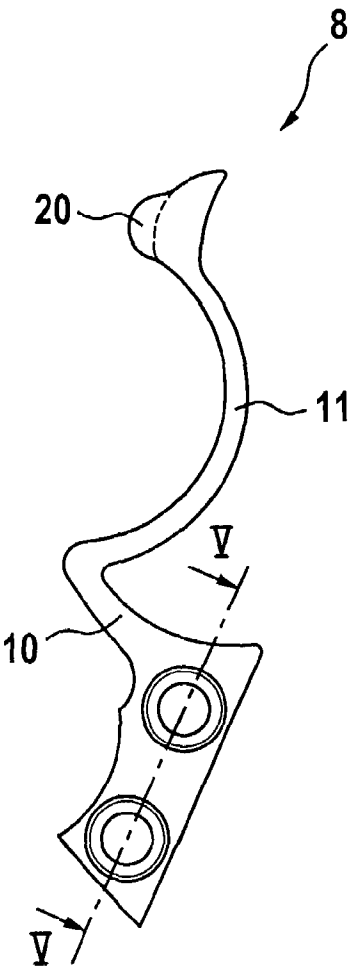
FIG. 2 is a plan view of a counterpressure spring of the precision regulating device of FIG. 1.
Figure 3:
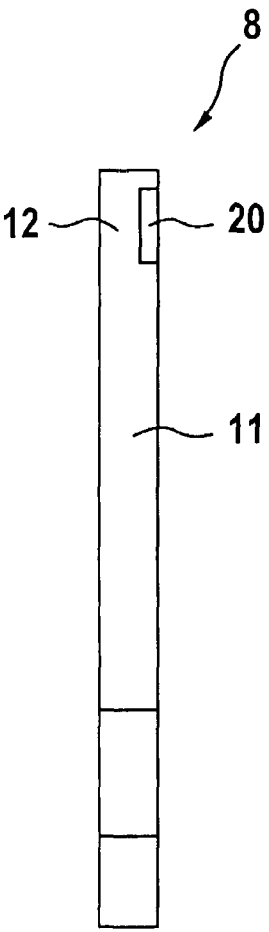
FIG. 3 is a side view of the counterpressure spring of FIG. 2.
Figure 4:
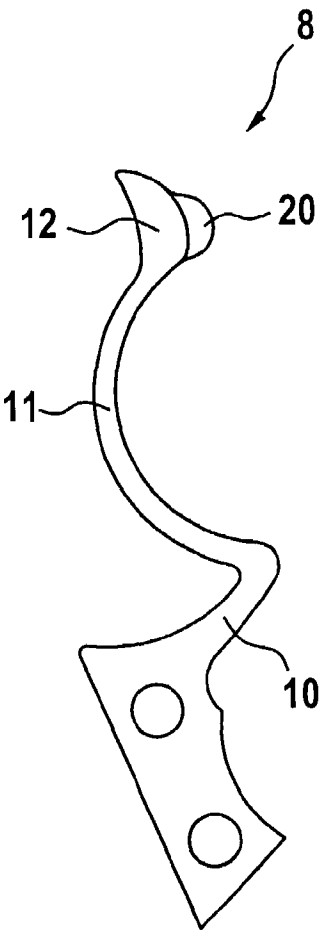
FIG. 4 is a rear view of the counterpressure spring according to FIG. 2.
Figure 5:
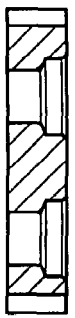
FIG. 5 is a sectional view of the counterpressure spring according to FIG. 2 along line V—V in FIG. 2.
Figure 8:
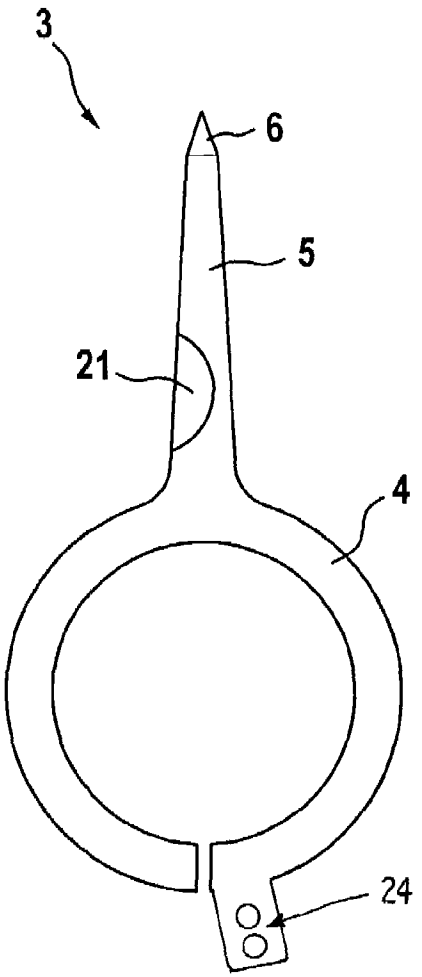
FIG. 8 is a rear view of the index regulator of FIG. 6.
Figure 7:
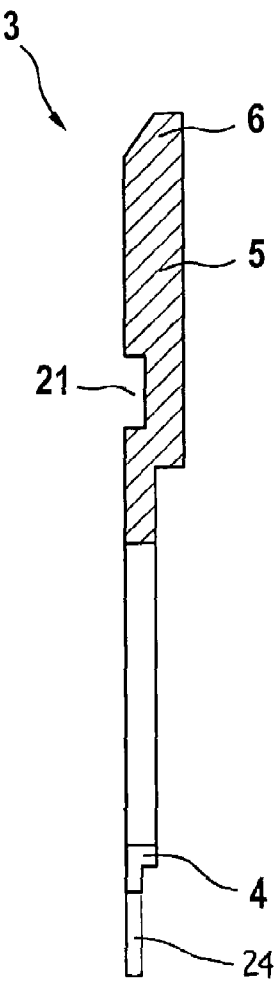
FIG. 7 is a cross section of the index regulator of FIG. 6 along line VII—VII in FIG. 6.
Figure 6:
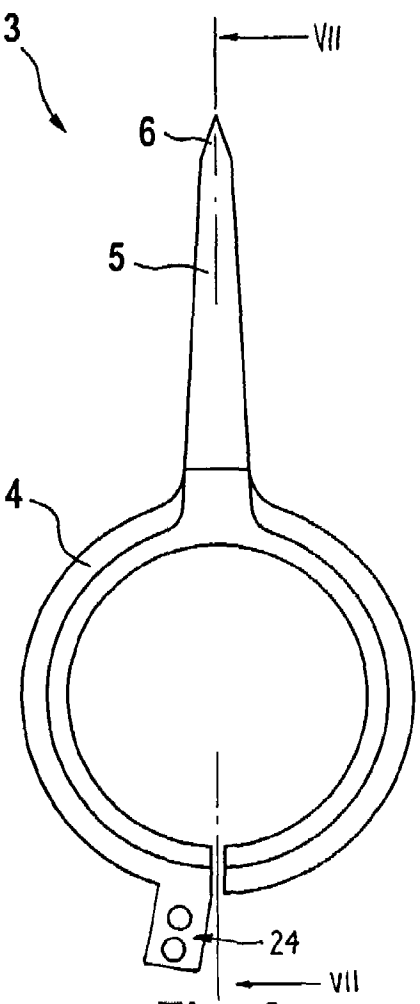
FIG. 6 is a front view of an index regulator of the precision regulating device of FIG. 1.
Figure 10:
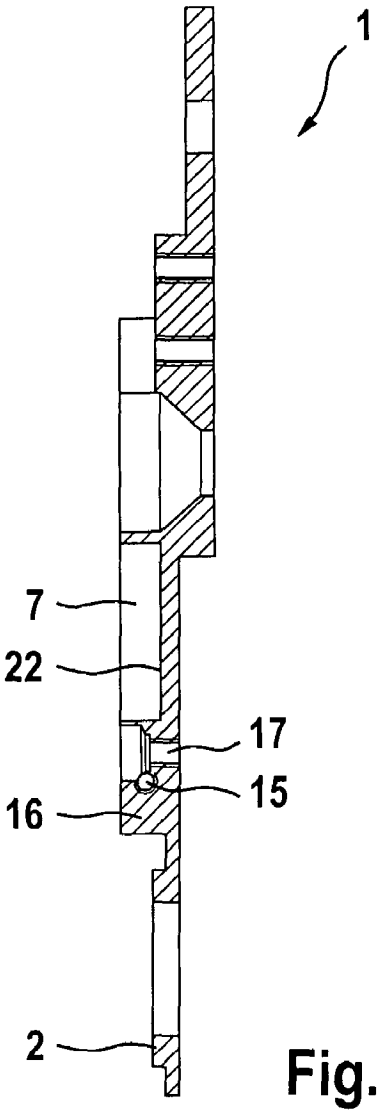
FIG. 10 is a sectional view of the balance cock according to FIG. 9 along line X—X in FIG. 9.
Figure 9:
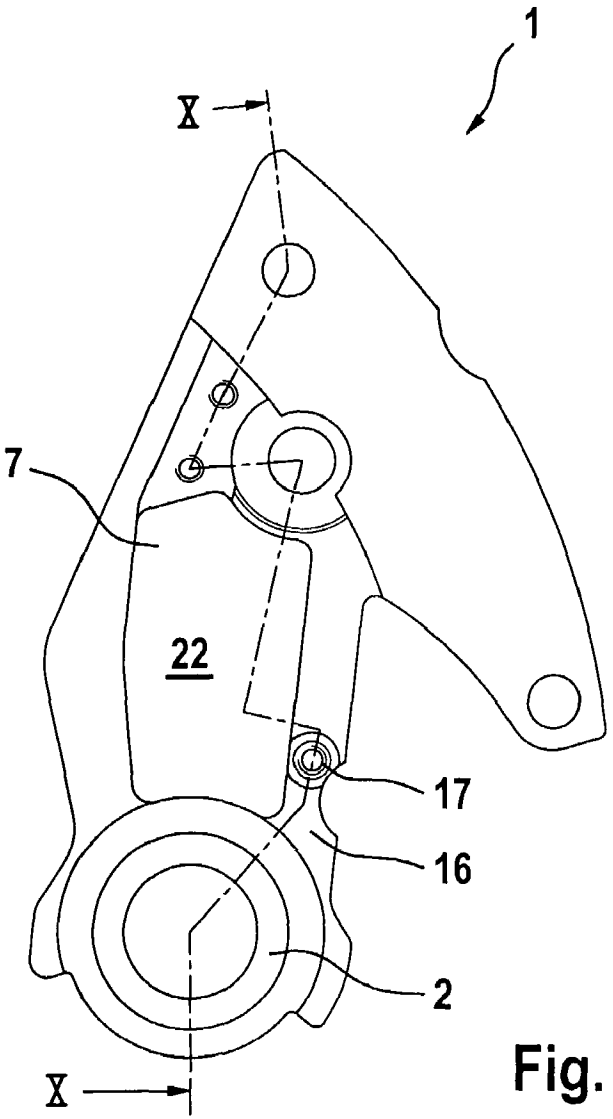
FIG. 9 is a front view of a balance cock of the precision regulating device in FIG. 1.

FIGS. 1–10 show a precision regulating device having a balance cock 1 with a projecting cylindrical extension 2 which forms a regulator axis. An index regulator 3 is mounted on the cylindrical extension 2 such that the index regulator can be pivoted by way of an annular bearing part 4.

As shown in FIGS. 1 and 6–8, a regulator pointer 5 of the index regulator 3 projects radially away from the annular bearing part 4, the regulator pointer 5 having a pointer tip 6 at its free end. The regulator pointer 5 here projects into a cutout 7 of the balance cock 1, the cutout 7 being recessed in the manner of a chamber. The index regulator 3 further includes a hairspring key 24 connectable to a hairspring of an oscillating system of a timepiece (the hairspring and timepiece are not shown in the drawings) for changing an active length of the hairspring. The adjustment of the hairpsring by an index regulator is known and is therefore not described in further detail.

In that end region of the cutout 7 which is radially opposite the cylindrical extension 2, one end of a counterpressure spring 8 is fixed to the balance cock 1 by two screws 9 (see FIGS. 1–5). Starting from the end region of the counterpressure spring 8 which is connected to the balance cock 1, an arm-like retaining region 10 of the counter pressure spring 8 projects approximately in the direction of rotary movement of the regulator pointer 5, approximately in the pivoting region of the pointer tip 6 of the regulator pointer 5.

The arm-like retaining region 10 is adjoined integrally by a resilient arm 11 which extends approximately concavely in relation to the longitudinal extent of the regulator pointer 5, approximately in the same plane as the latter. At its free end, the resilient arm 11 has a region of action 12 which is curved approximately convexly in relation to the longitudinal extent of the regulator pointer 5. The region of action 12 is directed towards the regulator pointer 5 and abuts the regulator pointer 5 so that the counterpressure spring 8 is prestressed in the pivoting direction 13. The regulator pointer 5 is thus held in abutment against the head end of a regulating screw 14, which is directed counter to the direction of action of the counterpressure spring 8.

The regulating screw 14 is arranged in a rotatable manner in a thread of a threaded bore 15 (see FIG. 10) in a side wall 16 of the recessed cutout 7 of the balance cock 1. The end region regulating screw 14 projects into the cutout 7 by way of its end region which has the head end, and positions the regulator pointer 5.

A further threaded bore 17 (see FIGS. 9 and 10) for accommodating a locking screw 18 is formed directly alongside the threaded bore 15, transversely to the longitudinal extent of the threaded bore 15. The screw head 19 of the locking screw 18 subjects the regulating screw 14 approximately tangentially to clamping action.

Over part of the thickness of the resilient arm 11, a convexly curved holding-down region 20 projects in a stepped manner beyond the likewise convexly curved region of action 12 of the resilient arm, and projects into a depression 21 on that side of the regulator pointer 5 which is directed towards the holding-down region 20 of the resilient arm 11. The regulator pointer 5 is thus secured against lifting off from the base 22 of the cutout 7 (see FIG. 10).

With the resilient arm 11 also being prestressed slightly in the direction of the base 22 of the cutout 7, the regulator pointer 5 does not lift off from the base 22 of the cutout 7 even in the case of relatively pronounced shocks. The base 22, at the same time, forms a stop for movement of the regulator pointer 5 toward the base 22.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A precision regulating device for a timepiece having an oscillating system with a hairspring, said precision regulating device comprising:

a balance cock;

an index regulator pivotally mounted on said balance cock such that said index regulator is pivotable in a pivoting direction about a regulator axis, said index regulator having a hairspring key arranged at a radial distance from said regulator axis for changing an active length of the hairspring of the oscillating system of the timepiece in response to pivoting of said index regulator about said regulator axis, said index regulator further comprising a regulator pointer extending radially from said regulator axis;

a regulating screw threadably connected to one of said balance cock and a component connected to said balance cock; and a counterpressure spring comprising a resilient arm and having first and second ends regions, said first end region of said counterpressure spring connected to said balance cock and said second end region comprising a free end region prestressed against said regulator pointer for urging said regulator pointer in the pivoting direction into abutment against said regulating screw such that said regulating screw provides a force on said regulator pointer opposing the urgency of said counterpressure spring, said resilient arm of said counterpressure spring having a holding-down region positionable on an axial side of said regulator pointer relative to said regulator axis.

2. The precision regulating device of claim 1, wherein said holding-down region is positionable on the axial side of said regulator pointer with a prestressing force.

3. The precision regulating device of claim 1, wherein said free end region of said resilient arm comprises a region of action which abuts said regulator pointer, said region of action being curved approximately convexly relative to the longitudinal extent of said regulator pointer.

4. The precision regulating device of claim 3, wherein said holding-down region is arranged on said free end region of said resilient arm proximate said region of action.

5. The precision regulating device of claim 3, wherein said region of action and said holding-down region are arranged in a stepped manner, approximately axially relative to said regulator axis such that said holding-down region projects further a direction toward said regulator pointer than said region of action.

6. The precision regulating device of claim 1, wherein said regulator pointer defines a depression on a circumferential side of said regulator pointer facing said holding-down region of said resilient arm, said holding-down region projecting from said resilient arm into said depression.

7. The precision regulating device of claim 1, wherein said regulator pointer and said resilient arm are approximately arranged in the same plane perpendicular to said regulator axis.

8. The precision regulating device of claim 1, wherein said resilient arm of said counterpressure spring extends approximately concavely relative to the longitudinal extent of said regulator pointer.

9. The precision regulating device of claim 8, wherein said counterpressure spring further comprises a retaining region extending from said first end region to an end of said resilient arm facing away from said holding-down region.

10. The precision regulating device of claim 9, wherein said retaining region extends from said first end region, approximately in the pivoting direction of said regulator pointer, proximate a pivoting region of a radially outermost tip of said regulator pointer.

11. The precision regulating device of claim 1, wherein said balance cock defines a recessed cutout on a side of said balance cock directed towards said regulator pointer, said regulator pointer and said counterpressure spring being arranged in said cutout such that said regulator pointer and said counter pressure spring are movable in a plane perpendicular to said regulator axis.

12. The precision regulating device of claim 11, wherein said balance cock defines a threaded bore designed for accommodating said regulating screw in a side wall of said recessed cutout.

13. The precision regulating device of claim 12, wherein a further threaded bore is defined in said balance cock extending axially relative to said regulator axis, a locking screw inserted in said further threaded bore includes a screw head adjustable for subjecting said regulating screw to clamping action.

* * * * *

UNITED STATES PATENT AND TRADEMARK OFFICE

CERTIFICATE OF CORRECTION

PATENT NO. : 7,036,977 B2
APPLICATION NO. : 10/859035
DATED : May 2, 2006
INVENTOR(S) : Hans Jürgen Mühle It is certified that error appears in the above-identified patent and that said Letters Patent is hereby corrected as shown below:

--[73] Assignee: Mühle-Glashütte GmbH Nautische Instrumente & Feinmechanik Glashütte (DE)--

Signed and Sealed this

Fifteenth Day of August, 2006

JON W. DUDAS
*Director of the United States Patent and Trademark Office*